US010519536B2

(12) United States Patent
Yamanishi et al.

(10) Patent No.: US 10,519,536 B2
(45) Date of Patent: Dec. 31, 2019

(54) METHOD OF PRODUCING CARBURIZING FORGING STEEL MATERIAL

(71) Applicant: TOYOTA JIDOSHA KABUSHIKI KAISHA, Toyota-shi (JP)

(72) Inventors: Kazuomi Yamanishi, Tajimi (JP); Hiroyuki Inoue, Aichi-gun (JP); Yuji Adachi, Nagoya (JP); Takeshi Usami, Tokai (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 27 days.

(21) Appl. No.: 15/769,541

(22) PCT Filed: Oct. 19, 2016

(86) PCT No.: PCT/IB2016/001499

§ 371 (c)(1),
(2) Date: Apr. 19, 2018

(87) PCT Pub. No.: WO2017/068410

PCT Pub. Date: Apr. 27, 2017

(65) Prior Publication Data

US 2018/0312956 A1 Nov. 1, 2018

(30) Foreign Application Priority Data

Oct. 20, 2015 (JP) ..... 2015-205994

(51) Int. Cl.

| | |
|---|---|
| ***C21D 8/02*** | (2006.01) |
| ***C23C 8/22*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/26*** | (2006.01) |
| ***C21D 6/00*** | (2006.01) |

(52) U.S. Cl.

CPC ..... *C23C 8/22* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/26* (2013.01); *C21D 2211/004* (2013.01); *C21D 2211/005* (2013.01); *C21D 2211/009* (2013.01)

(58) Field of Classification Search

CPC ..... C23C 8/22; C21D 8/0226; C21D 8/0263; C21D 8/0205; C21D 6/002; C21D 6/008; C21D 6/005

See application file for complete search history.

(56) References Cited

FOREIGN PATENT DOCUMENTS

| | | | |
|---|---|---|---|
| JP | 62-99416 | A | 5/1987 |
| JP | 2005-256142 | A | 9/2005 |
| JP | 2005-325438 | A | 11/2005 |
| JP | 2006-307270 | A | 11/2006 |
| JP | 2012-237052 | A | 12/2012 |
| JP | 5533712 | B2 | 6/2014 |

OTHER PUBLICATIONS

International Search Report dated Jan. 5, 2017 in PCT/IB2016/001499 filed Oct. 19, 2016.

*Primary Examiner* — Jessee R Roe

(74) *Attorney, Agent, or Firm* — Oblon, McClelland, Maier & Neustadt, L.L.P.

(57) ABSTRACT

A method of producing a carburizing forging material includes heating a steel material at 1300° C. or higher, forming Nb in a solid solution state and then rolling the steel material, heating the rolled steel material in a range of 950 to 1050° C., hot forging the heated steel material in a range of 950 to 1040° C., precipitating a Nb carbonitride in the steel material by cooling the steel material or maintaining a temperature of the steel material under a condition in which a time spent in a range of 950 to 970° C. is 1 minute or longer, precipitating a ferrite phase in the steel material by cooling the steel material or maintaining a temperature of the steel material under a condition in which a time spent in a range of 730 to 870° C. is 10 minutes or longer, and cooling the steel material to room temperature.

5 Claims, 2 Drawing Sheets

METHOD OF PRODUCING CARBURIZING FORGING STEEL MATERIAL

BACKGROUND OF THE INVENTION

1. Field of the Invention

The present invention relates to a method of producing a carburizing forging material.

2. Description of Related Art

Since a power transmission member made of a steel material of a gear or a shaft that is used for automobiles, construction vehicles, construction machines and the like requires both wear resistance and high toughness, the steel material is hot-forged to become a forging material, and is then subjected to a carburizing treatment. On the other hand, the carburizing treatment requires a very long treatment in some cases. Therefore, in consideration of treatment cost reduction, a treatment in which a carburizing temperature is set to be high has been studied. However, when the treatment temperature is set to be high, since abnormal grain growth of crystal grains is likely to occur, various production methods for preventing the abnormal grain growth are proposed.

As a method of producing such a carburizing forging material, for example, in Japanese Patent Application Publication No. 2005-256142 (JP 2005-256142 A), a method of producing a carburizing forging material is proposed in which a steel material that contains C: 0.1 to 0.35 mass %, Si: 0.05 to 0.5 mass %, Mn: 0.2 to 2.0 mass %, and one or two of Ti and Nb: 0.1 to 0.3 mass % and the balance includes Fe and inevitable impurities is used as a material, a heating temperature during hot forging is set to 1200° C. or higher, a cooling time of 5 minutes or longer is ensured at a temperature of 780° C. or higher after the hot forging, and the temperature of 780 to 500° C. is then reduced at a cooling rate of 2° C./sec or less.

According to the carburizing forging material obtained by this producing method, even when the carburizing treatment is performed at a high temperature of about 1050° C., a pinning effect in grain growth caused by a Nb carbonitride is exhibited. Therefore, it is possible to suppress abnormal grain growth of crystal grains. Accordingly, it is possible to suppress strength of the obtained forging material (carburizing material) from decreasing and suppress a variation of heat treatment distortion.

In addition to the attempts to increase a treatment temperature, attempts to reduce a treatment time in combination of application of a carburizing method under reduced pressure through which a hydrocarbon gas is introduced into a furnace under reduced pressure are being studied.

SUMMARY OF THE INVENTION

However, as in a producing method disclosed in JP 2005-256142A, the most common hot forging methods are usually performed at a temperature of about 1200° C. in consideration of deformation resistance and ease of processing. Also in JP 2005-256142 A, since heating before hot forging is performed under a condition of 1200° C. or higher, austenite crystal grains of a steel material become coarser during the hot forging. When the size of austenite crystal grains becomes larger, the number of precipitation sites at which precipitation occurs in a ferrite phase at grain boundaries of the austenite crystal grains is then reduced, and a progress area in a pearlite phase becomes larger. Accordingly, a ratio of the pearlite phase in the steel material increases and a bainite phase in the steel material is likely to be precipitated. As a result of this, a hardness of a carburizing forging material increases. Therefore, even if the carburizing forging material is to be processed to a desired size before the carburizing treatment, processibilty such as machinability thereof tends to decrease.

The present invention provides a method of producing a carburizing forging material through which it is possible to suppress abnormal grain growth and increase processibilty of a carburizing forging material before a carburizing treatment even when the carburizing treatment under reduced pressure is performed under a high temperature condition.

A first aspect of the present invention relates to a method of producing a carburizing forging material from a steel material that includes C: 0.20 to 0.30 mass %, Si: 0.03 to 1.50 mass %, Mn: 0.30 to 1.00 mass %, Cr: 0.30 to 2.50 mass %, Al: 0.025 to 0.100 mass %, N: 0.0120 to 0.0180 mass %, Nb: 0.05 to 0.10 mass %, and Mo: 0 to 0.80 mass %, and a balance: Fe and inevitable impurities, the method including: heating the steel material at 1300° C. or higher and forming Nb in a solid solution state in the steel material and then rolling the steel material; heating the steel material under a heating condition in a range of 950 to 1050° C. after the steel material is rolled; hot forging, under a heating condition in a range of 950 to 1040° C., the steel material that is heated under the heating condition in the range of 950 to 1050° C.; precipitating a Nb carbonitride in the steel material by cooling the steel material or maintaining a temperature of the steel material under a condition in which a time spent in a temperature range of 950 to 970° C. is 1 minute or longer after the steel material is hot forged; precipitating a ferrite phase in the steel material by cooling the steel material or maintaining a temperature of the steel material under a condition in which a time spent in a temperature range of 730 to 870° C. is 10 minutes or longer during cooling after the Nb carbonitride is precipitated in the steel material; and cooling the steel material to room temperature after the ferrite phase in the steel material is precipitated.

In the present invention, first, when heating is performed before rolling, the steel material is heated at 1300° C. or higher, and thus Nb is sufficiently formed in a solid solution state in the steel material. Accordingly, when Nb is then precipitated in the steel material, a large amount of the fine Nb carbonitride can be dispersed and precipitated in austenite crystal grains and at grain boundaries thereof. As a result of this, even if a carburizing treatment under reduced pressure is performed on the obtained carburizing forging material at a high temperature of about 1100° C., it is possible to suppress abnormal grain growth (coarsening) of the austenite crystal grains by a pinning effect according to the Nb carbonitride. Accordingly, it is possible to suppress strength of the obtained forging material (carburizing material) from decreasing and suppress a variation in heat treatment distortion.

A time for heating at 1300° C. or higher necessary for Nb to be sufficiently formed in a solid solution state changes somewhat according to a size of the steel material, and specifications and capacities of a heating furnace. Therefore, a heating test is performed in advance for a condition and a shorter time is set in a range in which Nb can be sufficiently formed in a solid solution state, which is advantageous in consideration of productivity. For example, the heating time may be 40 minutes or longer.

In addition, in the present invention, the temperature is set to be lower than that of a case in which hot forging is generally performed at about 1200° C., and refinement of austenite crystal grains of the forged steel material is attempted as a result. As a result, in a ferrite precipitation process, the number of precipitation sites at which precipitation occurs in a ferrite phase at grain boundaries of austenite crystal grains increases and it is possible to limit a progress area in a pearlite phase. Accordingly, a ratio of the steel material in the ferrite phase obtained after cooling increases, it is possible to suppress the pearlite phase in the steel material from increasing compared to a case in which a forging temperature is high, and it is possible to decrease a hardness of the obtained carburizing forging material. As a result, it is possible to increase processibilty such as machinability of the carburizing forging material before the carburizing treatment.

In the first aspect of the present invention, when the steel material is cooled to room temperature, the steel material may remain in a temperature range of 620 to 700° C. for a predetermined time. This is so that, when the steel material is cooled, pearlite transformation using the ferrite phase as a starting point is promoted.

In the first aspect of the present invention, a content ratio of P included in the steel material may be 0.03 mass % or less. This is so that it is possible to suppress strength at grain boundaries from decreasing and a fatigue characteristic from deteriorating.

In the first aspect of the present invention, a content ratio of S included in the steel material may be 0.025 mass % or less. This is so that it is possible to suppress fatigue breakdown from occurring and pitching resistance from decreasing.

According to the present invention, it is possible to increase processibilty of the carburizing forging material before the carburizing treatment and it is possible to suppress abnormal grain growth of crystal grains even if the carburizing treatment under reduced pressure is performed, for example, under a high temperature condition of about 1050 to 1100° C. As a result, it is possible to significantly reduce a carburizing treatment time, which can contribute to cost reduction.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
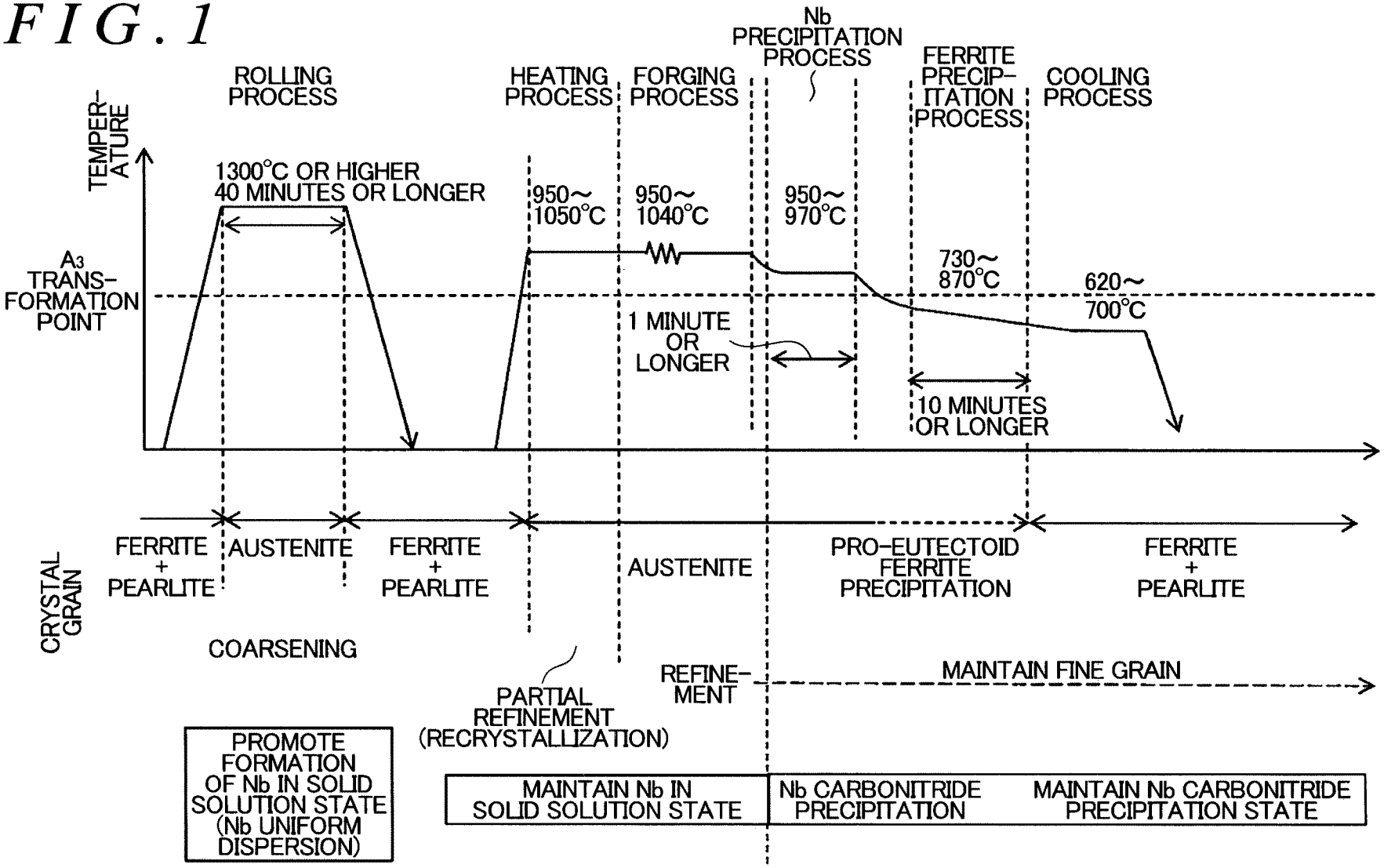
FIG. 1 is a diagram for describing processes of a method of producing a carburizing forging material according to the present embodiment.

A method of producing a steel material according to an embodiment of the present invention will be described below.

As a steel material used in the producing method according to the present embodiment, a steel material that contains C: 0.20 to 0.30 mass %, Si: 0.03 to 1.50 mass %, Mn: 0.30 to 1.00 mass %, Cr: 0.30 to 2.50 mass %, Al: 0.025 to 0.100 mass %, N: 0.0120 to 0.0180 mass %, Nb: 0.05 to 0.10 mass %, and Mo: 0 to 0.80 mass %, and the balance of which includes Fe and inevitable impurities is prepared. Here, the elements and content ratios thereof will be described in detail.

Carbon (C) whose content ratio is 0.20 to 0.30 mass % will now be described. C is an element that ensures internal strength (an internal hardness) that is unable to be enhanced by a carburizing treatment and C is contained at 0.20 mass % or more in order to obtain such an effect. However, when a large amount thereof is contained, internal toughness is degraded. Further, even when the present invention is applied, a hardness becomes greater than 200 Hv and it is difficult to ensure sufficient machinability. Therefore, an upper limit value of the content ratio of C is set to 0.30 mass %.

Silicon (Si) whose content ratio is 0.03 to 1.50 mass % will now be described. Si is an element for deoxidation when steel is produced and Si is contained at 0.03 mass % or more in order to obtain such an effect. However, when Si is excessively contained, a decrease in a concentration of C in a surface is caused after the carburizing treatment due to a decrease in toughness, a decrease in processibilty and a decrease in carburizability. Therefore, an upper limit value of the content ratio of Si is set to 1.50 mass %.

Manganese (Mn) whose content ratio is 0.30 to 1.00 mass % will now be described. Mn is an element that increases hardenability and ensures strength of an inside of a component. Mn is contained at 0.30 mass % or more in order to obtain such an effect. However, when a large amount thereof is contained, the residual austenite increases after carburizing and quenching, a hardness after the carburizing treatment decreases, internal toughness is degraded, and a decrease in machinability is caused. Therefore, an upper limit value of the content ratio of Mn is set to 1.00 mass %.

Chromium (Cr) whose content ratio is 0.30 to 2.50 mass % will now be described. Cr is an element that is necessary to increase hardenability and ensure strength of an inside. Cr is contained at 0.30 mass % or more in order to obtain such an effect. However, when a large amount thereof is contained, toughness is degraded, and a decrease in machinability is caused. In addition, a carbide is generated during the carburizing treatment and a decrease in the strength is caused. Therefore, an upper limit value of the content ratio of Cr is set to 2.50 mass %.

Aluminum (Al) whose content ratio is 0.025 to 0.100 mass % will now be described. Similarly to Si, Al is an element that is necessary for deoxidation. Furthermore, Al is an element that is included in the steel material as AlN, suppresses abnormal growth of crystal grains due to a pinning effect, and suppresses crystal grains after the carburizing treatment from coarsening. In order to ensure an amount of AlN necessary for deoxidation and obtaining the pinning effect, Al is contained at 0.025 mass % or more. On one hand, when the content ratio of Al is high to some extent, the pinning effect is maximized and an effect of preventing abnormal grain growth is not increased. On the other hand, Al oxide inclusions generated in the steel material increase and strength and machinability are impaired. Therefore, an upper limit value of the content ratio of Al is set to 0.100 mass %.

Nitrogen (N) whose content ratio is 0.0120 to 0.0180 mass % will now be described. As described above, N is an element that combines with Al or Nb to form AlN or a Nb carbonitride that is included in the steel material, and suppresses abnormal growth of crystal grains that occurs when the carburizing treatment is performed. In order to obtain such an effect, N is contained at 0.0120 mass % or more. However, a precipitation amount of the MN or Nb carbonitride needs to be included at an appropriate amount. When N is contained at an excessive amount, an effect of preventing abnormal grain growth is maximized. Furthermore, non-metal inclusions such as $Al_2O_3$ increase, and adversely, there is a risk of fatigue strength decreasing. Therefore, an upper limit value of the content ratio of N is set to 0.0180 mass %.

Niobium (Nb) whose content ratio is 0.05 to 0.10 mass % will now be described. Nb is an element that forms a Nb carbonitride and is included in the steel material after Nb precipitation, and suppresses abnormal growth of crystal grains in the carburizing treatment at a high temperature. When the content ratio of Nb is low, particularly, in the carburizing treatment at 1050° C. or higher, a part of the carbonitride that is precipitated before the carburizing treatment is in a solid solution state, an amount of the Nb carbonitride that contributes to the pinning effect is insufficient, and an effect of preventing abnormal grain growth is not sufficiently obtained. Therefore, a lower limit value of the content ratio of Nb is set to 0.05 mass %. On the other hand, when a large amount thereof is contained, it is difficult to form a solid solution state by heating at 1300° C. or higher. Therefore, an upper limit value of the content ratio of Nb is set to 0.10 mass %.

Molybdenum (Mo) whose content ratio is 0 to 0.80 mass % will now be described. Mo is an optional element and is not necessarily contained. On the other hand, since Mo is effective to increase hardenability, it can be contained to ensure necessary hardenability according to a size of a forged component. However, since Mo is an element that is relatively expensive compared to other elements and the price of a ferroalloy that is necessary for addition is high, an amount added may be reduced under a condition that necessary hardenability can be ensured. In addition, when the content ratio of Mo is too high, there is a possibility of toughness and machinability decreasing. Therefore, an upper limit value of the content ratio of Mo is set to 0.80 mass %.

Additionally, the following elements may be contained as inevitable impurities, but it is not preferable that large amounts thereof be contained. Hereinafter, details will be described.

P is an impurity that is unavoidably mixed during production. When P is excessively contained, strength at grain boundaries decreases and a fatigue characteristic is caused to deteriorate. Accordingly, for example, an upper limit value of the content ratio of P may be set to 0.03 mass %.

Similarly to P, S is an impurity that is unavoidably mixed in a small amount during production, and is included as, for example, a sulfide inclusion such as MnS. However, such an inclusion serves as an element that functions as a starting point of fatigue breakdown, decreases pitching resistance or increases anisotropy of the steel material. Accordingly, for example, an upper limit value of the content ratio of S may be set to 0.025 mass %.

A method of producing a carburizing forging material using the above-described steel material as a material will be described with reference to FIG. 1.

First, when heating is performed before a rolling process, the steel material that is cast to contain the above-described component is heated at 1300° C. or higher, and the steel material is then hot-rolled. A time for heating at 1300° C. or higher for Nb to be formed in a solid solution state changes somewhat according to a size of the steel material, and specifications and capacities of a heating furnace. Therefore, as described above, a test may be performed in advance and thus an optimal condition may be determined. For example, a time for heating at 1300° C. or higher may be 40 minutes or longer. According to the heating, the phase is transformed to an austenite phase, and Nb can be sufficiently formed in a solid solution state in an iron base in the transformed austenite phase.

Accordingly, in a subsequent Nb precipitation process, a large amount of the fine Nb carbonitride can be precipitated in austenite crystal grains and at grain boundaries thereof. As a result, during the carburizing treatment, when the steel material is heated at a high temperature of 1050° C. or higher, the pinning effect is sufficiently exhibited due to the precipitated Nb carbonitride, and it is possible to suppress abnormal grain growth of crystal grains of the steel material.

Here, when a heating temperature in the rolling process is lower than 1300° C. or when a heating time is not sufficient, Nb is not sufficiently formed in a solid solution state in the austenite phase of the steel material and a part of the Nb carbonitride remains. In general, the remaining Nb carbonitride remains in a coarse state even after the precipitation process and such a coarse Nb carbonitride does not contribute to the pinning effect. As a result, an effect of Nb that is specially added is not sufficiently obtained, and when the steel material is eventually subjected to the carburizing treatment at a high temperature of 1050° C. or higher, abnormal grain growth of crystal grains is unable to be suppressed.

Next, after the rolling process, the steel material cooled to room temperature once is heated again under a heating condition in a range of a heating temperature of 950 to 1050° C.

Here, when a heating temperature is lower than 950° C. in a heating process, forging of a post-process is difficult due to high deformation resistance. On the other hand, when a heating temperature is higher than 1050° C. in the heating process, the austenite crystal grains become larger, and processibilty of a forging material obtained after the forging and cooling described above decreases.

Next, the steel material in a heated state after the heating process is continuously subjected to hot forging under a heating condition in a range of a heating temperature of 950 to 1040° C. Accordingly, in addition to recrystallization (refinement of crystal grains) in the austenite phase that continues from when the heating process is performed, process distortion in the forging process is introduced and thus refinement of the austenite crystal grains is promoted.

Figure 2A:
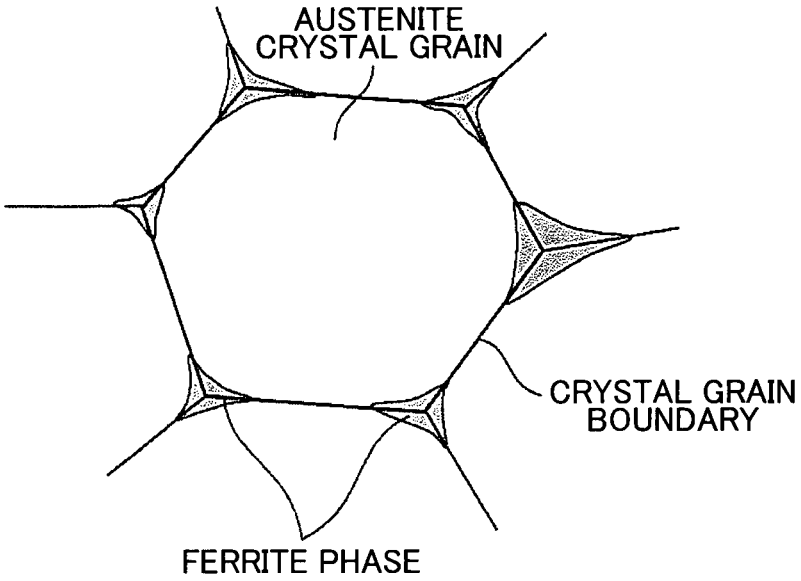
FIG. 2A is a diagram illustrating precipitation in a ferrite phase.
Figure 2B:
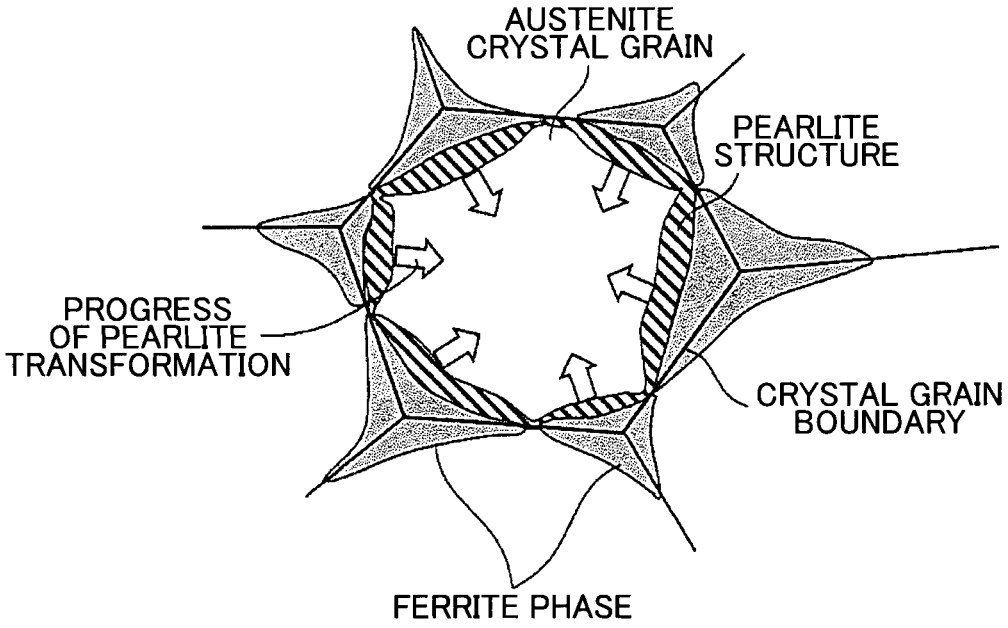
FIG. 2B is a diagram for describing progress in a pearlite phase using a ferrite phase as a starting point.

According to a series of processes from the heating process to the forging process, the austenite crystal grains are in a fine state compared to a case in which hot forging is performed at about 1200° C. of the related art and remain in a fine grain state regardless of transformation before a subsequent cooling process. Accordingly, as shown in FIG. 2A and FIG. 2B, in a ferrite precipitation process which will be described below, the number of precipitation sites at which precipitation occurs in a ferrite phase at grain boundaries of austenite crystal grains increases and it is possible to limit a progress area in a pearlite phase using the ferrite phase as a starting point thereafter.

As a result of this, a ratio of the steel material in the ferrite phase obtained after the cooling process which will be described below increases, and it is possible to suppress a precipitation amount in the pearlite phase from increasing. In addition, since a progress rate of pearlite transformation increases, the bainite phase is hardly precipitated.

Here, when a heating temperature is lower than 950° C. in the forging process, deformation resistance of the steel material increases and forging is difficult. On the other hand, when a heating temperature is higher than 1040° C. in the forging process, there is a risk of refinement of austenite crystal grains according to hot forging being insufficiently promoted.

Next, when the steel material after the forging process is continuously cooled, if a time of 1 minute or longer in a temperature range of 950 to 970° C. is ensured, the Nb carbonitride is precipitated in the austenite crystal grains of the steel material and at grain boundaries thereof. Accordingly, a large amount of the fine Nb carbonitride is precipitated in the refined austenite crystal grains and at grain boundaries thereof and it is possible to suppress abnormal grain growth of the austenite crystal grains during the carburizing treatment.

Here, in the Nb precipitation process, when a time spent in a temperature range of 950 to 970° C. is shorter than 1 minute, a time necessary for precipitation is not ensured and the Nb carbonitride is not sufficiently precipitated. In addition, when a cooling rate is adjusted in another temperature range, and particularly, in a range lower than 950° C., Nb precipitation is not efficiently performed compared to when a cooling rate is adjusted in a temperature range of 950 to 970° C. When a cooling rate is not adjusted, generally, the temperature range may be passed in a few seconds after forging.

When a cooling rate is not adjusted in a temperature range of 950 to 970° C. and the temperature range is passed in a few seconds, Nb remains in the austenite phase in a solid solution state. Therefore, when cooling is performed after the ferrite precipitation process, progress of pearlite transformation using the ferrite phase as a starting point becomes slower, and the phase is easily changed to the bainite phase. Accordingly, a hardness of the obtained steel material (carburizing forging material) increases, and there is a possibility of machinability of the carburizing forging material decreasing. Further, when the carburizing treatment of the carburizing forging material is performed, since the Nb carbonitride is not sufficiently precipitated, the pinning effect according to the Nb carbonitride is not sufficiently exhibited and crystal grains of the carburizing forging material are highly likely to become mixed grains in which coarse grains and fine grains are mixed.

In addition, when a cooling rate is adjusted at a temperature higher than 970° C. in order to precipitate Nb, Nb can be precipitated but the precipitated Nb carbonitride grows rapidly and easily becomes coarser rather than becoming finer due to a high temperature. As a result, when the carburizing treatment of the obtained carburizing forging material is performed, a large amount of the fine Nb carbonitride is not precipitated and the pinning effect according to the Nb carbonitride is not effectively exhibited. Here, in adjustment of the cooling rate in the Nb precipitation process, slow cooling may be performed in a temperature range of 950 to 970° C. and a time spent in the range may be 1 minute or longer, or a temperature may be temporarily maintained in a specific temperature within the temperature range and the time spent in the range may be 1 minute or longer as a result. This is so that it is possible to ensure a sufficient time for Nb to be precipitated in any of the methods.

Next, the steel material after the Nb precipitation process is continuously cooled, a time of 10 minutes or longer in a temperature range of 730 to 870° C. is ensured, and thus precipitation occurs in a ferrite phase (in a pro-eutectoid ferrite phase) in the steel material. "10 minutes or longer" here indicates that the steel material may remain in a specific temperature in a range of 730 to 870° C. and the temperature may be slowly reduced for cooling over the course of 10 minutes or longer. As a result, precipitation occurs in the ferrite phase at grain boundaries of the austenite crystal grains as shown in FIG. 2A.

Since the austenite crystal grains are maintained as fine grains as described above, the number of sites at which precipitation occurs in a ferrite phase during the ferrite precipitation process is greater than that of the steel material that is generally heated at a temperature of about 1200° C. and forged. As a result, when the cooling process is performed after the ferrite precipitation process, as shown in FIG. 2B, even if pearlite transformation progresses with the ferrite phase as a starting point, it is possible to suppress a large amount of precipitation in the pearlite phase in a structure of the steel material and it is possible to suppress precipitation in the bainite phase. As a result, a hardness of the obtained steel material (carburizing steel material) is reduced more than ever before and it is possible to obtain the carburizing forging material having high machinability before the carburizing treatment.

Here, the temperature range of 730 to 870° C. is a temperature range in which precipitation occurs in the ferrite phase. When the time spent in the range is shorter than 10 minutes, a precipitation time in the ferrite phase is reduced and a ratio of the ferrite phase in the steel material tends to be smaller. As a result, after the ferrite precipitation process, there is a possibility of a ratio of the steel material in the pearlite phase obtained after cooling to room temperature increasing, pearlite transformation also slowly progresses with the ferrite phase as a starting point, and the bainite phase occurs. Accordingly, a hardness of the obtained steel material (carburizing forging material) increases and there is a possibility of machinability of the carburizing forging material decreasing.

Next, the heated steel material after the ferrite precipitation process is cooled to room temperature. Accordingly, as shown in FIG. 2B, pearlite transformation progresses with the ferrite phase as a starting point and it is possible to obtain the carburizing forging material that includes fine grains in the ferrite phase and the pearlite phase. Here, a cooling condition in the cooling process is not separately designated. This is because the same effect is obtained under a condition such as slow cooling, air cooling, radiational cooling, or accelerated air cooling (fan cooling). As shown in FIG. 1, the steel material remains in a temperature range of 620 to 700° C. for a certain time and transformation to the pearlite phase may be promoted.

A mechanical process such as a cutting process according to a shape of a component that is produced from the carburizing forging material after the cooling process is performed. In the present embodiment, since machinability of the steel material is more excellent than ever before, it is possible to easily perform the process without separately performing a heat treatment such as annealing. Then, the carburizing treatment is performed on the steel material after the mechanical process.

In a carburizing process, a carburizing treatment of the steel material is performed under a high temperature condition by a carburizing method under reduced pressure. Specifically, the steel material (a carburizing hot forged component) is heated at a high temperature of 1050° C. or higher (specifically, about 1100° C.), a hydrocarbon gas such as acetylene gas is introduced into a furnace under reduced pressure, and thus the steel material is carburized. In this case, a pulse carburizing method in which a process (a carburizing period) in which the carburizing gas is introduced into the furnace and the pressure is increased to a predetermined carburizing gas pressure, and the carburizing gas pressure is maintained and a process (a diffusion period) in which the carburizing gas is exhausted from the inside of the furnace and a carbon is diffused to the inside from a surface of the carburized steel material are alternately repeated for the carburizing treatment may be performed.

In the present embodiment, while crystal grains of the steel material are refined, a large amount of the fine Nb carbonitride is precipitated. Due to the resultant pinning effect, even if the carburizing treatment is performed under a high temperature condition of 1050° C. or higher, it is possible to suppress austenite crystal grains of the steel material from coarsening and maintain fine crystal grains. Accordingly, it is possible to obtain a forged component having excellent mechanical strength.

Hereinafter, the present invention will be described in detail with reference to examples.

Example 1

An example of a forged component for the high temperature carburizing treatment under reduced pressure and a method of producing the same will be described. In this example, first, in order to know an influence when a component was changed, as shown in Table 1, ten types of steel materials (samples Nos. 1 to 10) whose chemical compositions were different were prepared. Cylindrical test pieces whose heights were 1.5 times their diameters (diameter: height=1:1.5) were prepared. An upsetting process was performed under a condition which will be described below. Hardnesses of the test pieces after the process were evaluated and it was evaluated whether crystal grains became coarser according to a high temperature carburizing treatment under reduced pressure that was performed thereafter. The hardness was measured at the same position on side surfaces at the center in a height direction of all of the test pieces.

TABLE 1

| Sample | Chemical composition (mass %) | | | | | | | | | | |
|---|---|---|---|---|---|---|---|---|---|---|---|
| No. | C | Si | Mn | P | S | Cr | Mo | Al | N | Nb | Fe |
| 1 | 0.25 | 0.25 | 0.81 | 0.015 | 0.015 | 1.20 | — | 0.032 | 0.0144 | 0.09 | bal. |
| 2 | 0.24 | 0.30 | 0.96 | 0.014 | 0.015 | 2.01 | — | 0.050 | 0.0173 | 0.07 | bal. |
| 3 | 0.20 | 0.04 | 0.33 | 0.008 | 0.005 | 0.33 | — | 0.094 | 0.0175 | 0.05 | bal. |
| 4 | 0.30 | 1.47 | 0.65 | 0.033 | 0.030 | 0.81 | — | 0.037 | 0.0163 | 0.10 | bal. |
| 5 | 0.22 | 1.00 | 0.84 | 0.020 | 0.019 | 2.46 | — | 0.063 | 0.0155 | 0.06 | bal. |
| 6 | 0.25 | 0.26 | 0.80 | 0.014 | 0.014 | 1.32 | 0.77 | 0.036 | 0.0140 | 0.08 | bal. |
| 7 | 0.32 | 0.25 | 0.78 | 0.015 | 0.014 | 1.12 | — | 0.043 | 0.0151 | 0.09 | bal. |
| 8 | 0.20 | 0.33 | 0.50 | 0.017 | 0.013 | 1.19 | — | 0.020 | 0.0168 | 0.07 | bal. |
| 9 | 0.30 | 0.53 | 0.71 | 0.016 | 0.011 | 1.02 | — | 0.036 | 0.0107 | 0.08 | bal. |
| 10 | 0.22 | 0.98 | 0.83 | 0.018 | 0.015 | 1.96 | — | 0.048 | 0.0152 | 0.04 | bal. |

The test pieces were prepared as follows. First, steel materials having chemical compositions shown in Table 1 were dissolved in an electric furnace and prepared by casting. The steel materials heated at 1300° C. were extended and forged and base materials for the test pieces were prepared. Then, cylindrical test pieces were prepared by a mechanical process. In heating during the extending and forging, heating and maintaining were performed at 1300° C. for 60 minutes in order for Nb to be sufficiently formed in a solid solution state. Here, the extending and forging corresponds to a rolling process in actual production.

Next, as a method of evaluating hot forging according to an experiment, the upsetting process was selected. Specifically, the test pieces were heated to 1000° C. and then were subjected to the upsetting process (compression rate of 60%) at 1000° C. without change. Then, the test pieces remained at 950° C. for 1 minute during cooling after the upsetting process, remained at 730° C. for 10 minutes during subsequent cooling, then remained at 680° C. for 30 minutes, and were subsequently cooled to room temperature. These processes were performed on the upsetting test pieces that were prepared for each chemical composition twice. One was used for hardness measurement and the other was used for a carburizing treatment under reduced pressure. The carburizing treatment under reduced pressure was performed at a carburizing temperature of 1100° C. Then, a metal structure after the carburizing treatment was observed and quality thereof was evaluated.

In the carburizing treatment under reduced pressure, a treatment was performed for about 5 minutes that was the sum of the carburizing period and the diffusion period under a reduced-pressure atmosphere in which an inner pressure in the furnace in the carburizing period was 150 Pa. Acetylene gas was used as an atmospheric gas and the carburizing treatment was performed by the pulse carburizing method. In addition, after the carburizing treatment, a quenching treatment was performed by a gas cooling method using nitrogen gas. The test pieces treated so far after the upsetting process were cut along a surface including a test piece center and a metal structure of the cut surface was observed under a microscope.

The evaluation results are shown in Table 2. As shown in Table 2, in samples having an appropriate chemical composition (samples Nos. 1 to 6), hardnesses of 200 Hv or lower, which generally indicates favorable machinability, were obtained and crystal grains were also fine. On the other hand, in a sample in which C was outside an upper limit value (sample No. 7), a hardness was greater than 200 Hv, and a decrease in machinability was a concern. In addition, results of test pieces in which Si, Mn, or Cr was outside a range of the present invention are not described in this example. However, as described above, in a sample in which Si was outside an upper limit value (1.50 mass %), carburizability decreased, a carbon concentration in the surface was reduced more than that of a carburizing component of the related art, and a tendency of a decrease in a surface hardness after the carburizing was confirmed. In addition, in a sample in which Mn was outside an upper limit value (1.00 mass %), an amount of the residual austenite after the carburizing treatment increased and a tendency of a decrease in the surface hardness after carburizing was confirmed. In addition, in samples in which Cr was outside an upper limit value (2.50 mass %), an increase of a carbide in a carburizing portion was observed. The presence of the carbide may have an adverse effect on strength, and thus such samples were determined as not preferable as the carburizing forging material. In samples in which at least one component of Al, N and Nb was less than the above-described lower limit value (samples Nos. 8 to 10), in the test pieces after the carburizing treatment, crystal grains that grew abnormally and coarse grains were observed at a part of an observation surface.

TABLE 2

| Sample No. | Characteristic: Hardness before carburizing [Hv] | Characteristic: Presence of coarse grains after carburizing* |
|---|---|---|
| 1 | 188 | No |
| 2 | 175 | No |
| 3 | 171 | No |
| 4 | 198 | No |
| 5 | 184 | No |
| 6 | 195 | No |
| 7 | 221 | No |
| 8 | 186 | Yes |
| 9 | 195 | Yes |
| 10 | 183 | Yes |

*In a grain size number, compared to crystal grains of parts that are not coarsened, the presence of crystal grains that are coarsened to No. 3 or more.

Example 2

In Example 2, among the steel materials shown in Table 1, the steel material of the sample No. 1 was used. A plurality of cylindrical test pieces having the same shape as in Example 1 was prepared. An experiment was performed under producing conditions shown in Table 3. Similarly to Example 1, hardnesses were evaluated and it was evaluated whether abnormal grain growth occurred according to a high temperature carburizing treatment under reduced pressure that was performed thereafter.

TABLE 3

| Test No. | During extending and forging Heating temperature [° C.] | Heating process Heating temperature [° C.] | Upsetting process Temperature [° C.] | Nb precipitation process Temperature [° C.] | Nb precipitation process Maintaining time [min] | Ferrite precipitation process Temperature [° C.] | Ferrite precipitation process Maintaining time [min] |
|---|---|---|---|---|---|---|---|
| 1 | 1300 | 1000 | 1000 | 950 | 1 | 730 | 10 |
| 2 | 1300 | 1050 | 1040 | 950 | 1 | 870 | 10 |
| 3 | 1300 | 1000 | 950 | 970 | 1 | 870 | 10 |
| 4 | 1300 | 1000 | 1000 | Cooling 970° C. to 950° C. at Δ0.2° C./sec | | 800 | 10 |
| 5 | 1300 | 950 | 950 | 950 | 1 | Cooling 870° C. to 730° C. at Δ10° C./min | |
| 6 | 1300 | 1050 | 1040 | Cooling 970° C. to 950° C. at Δ0.2° C./sec | | Cooling 870° C. to 730° C. at Δ10° C./min | |
| 7 | 1280 | 1000 | 1000 | 950 | 1 | 730 | 10 |
| 8 | 1300 | 1100 | 1000 | 970 | 1 | 800 | 10 |
| 9 | 1300 | 1200 | 1040 | 970 | 1 | 800 | 10 |
| 10 | 1300 | 1050 | 1050 | 950 | 1 | 870 | 10 |
| 11 | 1300 | 1000 | 1000 | 940* | 1 | 730 | 10 |
| 12 | 1300 | 1000 | 1000 | Cooling 970° C. to 950° C. at Δ4° C./sec | | 800 | 10 |
| 13 | 1300 | 1000 | 1000 | 950 | 1 | Cooling 870° C. to 730° C. at Δ15° C./min | |

*970° C. to 950° C. indicate uncontrolled cooling (about a few seconds)

Although not shown in Table 3, after the ferrite precipitation process, similarly to Example 1, the test pieces remained at 680° C. for 30 minutes, and were then cooled to room temperature. Similarly to Example 1, the carburizing treatment under reduced pressure was performed at a carburizing temperature of 1100° C.

The evaluation results are shown in Table 4. The definition of coarse grains shown in Table 4 is the same as in Table 2. Here, the sample No. 5 was an example in which the test piece was heated to 950° C. during the heating process, was then subjected to the upsetting process at 950° C. without decreasing the temperature, and was subjected to the Nb precipitation process at that temperature. As can be understood from Table 4, in the tests Nos. 1 to 6 in which evaluation was performed under appropriate conditions, hardnesses of 200 Hv or lower, which generally indicates favorable machinability, were satisfied, crystal grains were fine, and coarse grains were not observed.

TABLE 4

| Test No. | Characteristic: Hardness before carburizing [Hv] | Characteristic: Presence of coarse grains after carburizing |
|---|---|---|
| 1 | 188 | No |
| 2 | 194 | No |
| 3 | 191 | No |
| 4 | 178 | No |
| 5 | 173 | No |
| 6 | 181 | No |
| 7 | 191 | Yes |
| 8 | 218 | No |
| 9 | 226 | No |
| 10 | 202 | No |
| 11 | 208 | Yes |
| 12 | 244 | Yes |
| 13 | 237 | No |

On the other hand, in the test piece obtained after the upsetting process of the test No. 7, while a hardness was 200

Hv or lower, coarse grains were observed in the crystal grains after carburizing under reduced pressure. This is considered to be caused by the fact that, since a heating temperature during extending and forging was lower than 1300° C., Nb in a solid solution state was insufficient, a part of the Nb carbonitride remained in a state that was not a solid solution state, Nb was included as a coarse Nb carbonitride even after the Nb precipitation process, added Nb did not sufficiently contribute to the pinning effect, and a crystal grain coarsening resistance characteristic decreased as a result.

In the tests Nos. 8 to 10, it is considered that, since a temperature during the heating process or a temperature during the upsetting process was too high, austenite crystal grains did not become fine, the number of sites at which precipitation occurred in a ferrite phase did not increase as a result, and thus a hardness was greater than 200 Hv.

In the tests Nos. 11 and 12, hardnesses of the test pieces after the upsetting process were greater than 200 Hv and coarse grains were observed in crystal grains after carburizing under reduced pressure as a result and it is speculated that a hardness was high in these two because a large amount of the fine Nb carbonitride was not sufficiently precipitated due to an inappropriate Nb precipitation process, and was cooled in a solid solution state in the austenite phase, and thus progress of pearlite transformation was slow as a result, while in the crystal grains, a large amount of the fine Nb carbonitride was not precipitated, and as a result, abnormal grain growth of the crystal grains occurred.

In addition, the test No. 13 was an example in which a cooling rate of the ferrite precipitation process was too fast, and a time spent in a temperature range of 730 to 870° C. was shorter than 10 minutes. However, since a time spent in the ferrite precipitation process was short, a ratio of precipitation in the ferrite phase decreased and a hardness increased.

An embodiment of the present invention has been described above in detail. However, the present invention is not limited to the embodiment, and various design modifications can be made within the ranges without departing from the scope and spirit of the present invention described in the appended claims.

The invention claimed is:

1. A method of producing forging material for a carburizing treatment wherein the forging material is a steel material comprising:

C: 0.20 to 0.30 mass %,
Si: 0.03 to 1.50 mass %,
Mn: 0.30 to 1.00 mass %,
Cr: 0.30 to 2.50 mass %,
Al: 0.025 to 0.100 mass %,
N: 0.0120 to 0.0180 mass %,
Nb: 0.05 to 0.10 mass %, and
Mo: 0 to 0.80 mass %, and
a balance: Fe and inevitable impurities,
the method comprising:

heating the steel material at 1300° C. or higher and forming Nb in a solid solution state in the steel material;

rolling the steel material at the temperature of 1300° C. or higher;

heating the rolled steel material in a range of 950 to 1050° C.;

hot forging the steel material obtained by the heating at 950 to 1050° C. under a heating condition in a range of 950 to 1040° C.;

adjusting the temperature of the forged steel material to 950 to 970° C. and maintaining that temperature for 1 minute or more to precipitate a Nb carbonitride in the hot forged steel material;

cooling the Nb carbonitride precipitated steel material to a temperature range of 730 to 870° C. and maintaining that temperature for 10 minutes or longer to precipitate a ferrite phase in the Nb carbonitride precipitated steel material; and cooling the Nb carbonitride and ferrite precipitated steel material to room temperature.

2. The method according to claim 1, wherein, the steel material is rolled at 1300° C. or higher for 40 minutes or longer.

3. The method according to claim 1, further comprising, when the Nb carbonitride and ferrite precipitated steel material is cooled to room temperature, maintaining the steel material in a temperature range of 620 to 700° C. for a predetermined time.

4. The method according to claim 1, wherein a content of P in the steel material is 0.03 mass % or less.

5. The method according to claim 1, wherein a content of S in the steel material is 0.025 mass % or less.

* * * * *